US011653725B1

(12) United States Patent
Chung

(10) Patent No.: US 11,653,725 B1
(45) Date of Patent: May 23, 2023

(54) ANTI-PINCH ZIPPER

(71) Applicant: KCC ZIPPER CO., LTD., Zhejiang (CN)

(72) Inventor: Chun-Yen Chung, New Taipei (TW)

(73) Assignee: KCC ZIPPER CO., LTD., Zhejiang (CN)

( * ) Notice: Subject to any disclaimer, the term of this patent is extended or adjusted under 35 U.S.C. 154(b) by 0 days.

(21) Appl. No.: 17/552,671

(22) Filed: Dec. 16, 2021

(30) Foreign Application Priority Data

Nov. 9, 2021 (TW) ..... 110141644
Nov. 9, 2021 (TW) ..... 110213193

(51) Int. Cl.
*A44B 19/24* (2006.01)
*A44B 19/26* (2006.01)
*A44B 19/08* (2006.01)
*A44B 19/30* (2006.01)

(52) U.S. Cl.
CPC ..... *A44B 19/265* (2013.01); *A44B 19/08* (2013.01); *A44B 19/303* (2013.01)

(58) Field of Classification Search
CPC ..... A44B 19/265; A44B 19/303; A44B 19/08
See application file for complete search history.

(56) References Cited

U.S. PATENT DOCUMENTS 2,510,736 A * 6/1950 Bogenberger ..... A44B 19/265 24/419
2,824,352 A * 2/1958 Foltis ..... A44B 19/265 24/429
2,855,652 A * 10/1958 Jones ..... A44B 19/265 24/426
2,905,996 A * 9/1959 Jones ..... A44B 19/265 24/426
2,933,792 A * 4/1960 Malmborg ..... A44B 19/265 24/426
3,046,627 A * 7/1962 Morin ..... A44B 19/38 24/433
4,261,082 A * 4/1981 Kamiya ..... A44B 19/265 24/428
4,586,220 A * 5/1986 Ogura ..... A44B 19/38 24/433
4,819,308 A * 4/1989 Baroky ..... A44B 19/265 24/418

(Continued)

FOREIGN PATENT DOCUMENTS

CN 104106888 A 10/2014
CN 106333432 A 1/2017

(Continued)

*Primary Examiner* — Jason W San
(74) *Attorney, Agent, or Firm* — Pai Patent & Trademark Law Firm; Chao-Chang David Pai

(57) ABSTRACT

An anti-pinch zipper includes two zipper tapes and a zipper slider. The inner side of the chain cloth of each zipper tape is folded back to the front to form a chain belt portion and a sliding space. The zipper slider has a top plate that holds the pull tab and is provided with a structure to guide the two rows of teeth of the zipper tapes to be interlocked with each other. The rows of teeth and the chain belt portions are passed through the zipper slider, so that the top plate and the pull tab are located on the front of the zipper, and the two chain cloths cover the back of the zipper slider.

10 Claims, 15 Drawing Sheets

(56) References Cited

U.S. PATENT DOCUMENTS 5,131,120 A * 7/1992 Akashi ..... A44B 19/388 24/433
5,586,370 A * 12/1996 Fudaki ..... A44B 19/38 24/433
6,490,770 B1 * 12/2002 Matsuda ..... A44B 19/26 24/426
6,510,590 B1 * 1/2003 Lin ..... A44B 19/306 24/49.1
6,588,072 B1 * 7/2003 Lin ..... A44B 19/265 24/429
6,701,584 B2 * 3/2004 Metzger ..... A44B 19/265 24/426
8,844,101 B2 * 9/2014 Nozaki ..... A44B 19/382 24/433
9,968,166 B2 * 5/2018 Inukai ..... A44B 19/265
10,212,992 B2 * 2/2019 Honda ..... A44B 19/262
2003/0115725 A1 * 6/2003 Matsumoto ..... A44B 19/388 24/433
2003/0177616 A1 * 9/2003 Petravic ..... A44B 19/265 24/415
2003/0213107 A1 * 11/2003 Mizuhara ..... A44B 19/388 24/433
2004/0181919 A1 * 9/2004 Mizuhara ..... A44B 19/38 24/387
2004/0181920 A1 * 9/2004 Mizuhara ..... A44B 19/38 24/387
2004/0205942 A1 * 10/2004 Tsaur ..... A44B 19/388 24/433
2005/0050699 A1 * 3/2005 Yoneoka ..... A44B 19/388 24/433
2006/0282998 A1 * 12/2006 Kusayama ..... A44B 19/382 24/434
2007/0071367 A1 * 3/2007 Buchman ..... B65D 33/2588 24/399
2014/0230197 A1 * 8/2014 Miyazaki ..... A44B 19/403 112/475.16
2019/0357637 A1 * 11/2019 Hamada ..... A44B 19/262

FOREIGN PATENT DOCUMENTS

CN 107567291 A 1/2018
CN 211298642 U 8/2020
EP 3289908 A1 3/2018
JP 2004-24740 A 1/2004
JP 5715576 B2 3/2015
WO 2014033926 A1 3/2014

* cited by examiner

I - I

II－II

Ⅲ－Ⅲ

ANTI-PINCH ZIPPER

BACKGROUND OF THE INVENTION

(a) Field of the Invention

The present invention relates to zipper technology and more particularly to an anti-pinch zipper that can prevent the zipper slider from being caught in the cloth of the garment.

(b) Description of the Prior Art

The zippers commonly used on clothing today, whether they are used in the pockets of clothing, the opening of the trousers/skirts, or the two plackets of the jacket, as long as the clothing has an inner lining, when the zipper slider moves, it may clamp the fabric inside, causing the zipper slider to move unevenly. If it is seriously involved in the inner fabric, the entire zipper slider may be stuck and unable to advance or retreat. It often requires destructive repairs to restore the original functions of the clothing and the zipper.

In order to prevent the zipper slider from being caught in the inner fabric of the garment, the patent cases of WO2014033926A1 and U.S. Pat. No. 6,701,584B2 propose a technology to install a guide at the front end of the zipper slider. Through the guide, the angle of the chain separated on both sides into the zipper slider is reduced, and the inner fabric is prevented as much as possible from being drawn into the zipper slider with the chain. However, the added guide makes the zipper slider larger and destroys the overall appearance of the clothing. Moreover, as the shape and size of the original zipper slider are different, matching guides must be implemented, so it is not widely used in clothing.

Other known anti-pinch zipper slider technologies, such as EP3289908A1, Japanese Patent Publication JP2004024740A, JP5715576B2, and Chinese Patent Publication CN107567291A, CN106333432A, CN104106888A, CN211298642U, etc., only use the zipper slider to push open the inner fabric, in an attempt to avoid the zipper slider from getting into the inner fabric of the clothes, instead of using the zipper cloth to completely separate the inner fabric from the zipper slider, so the actual anti-pinch effect is not ideal.

Also refer to the U.S. Pat. No. 8,225,466B2 disclosing a slider for a concealed type slide fastener with a separable bottom end stop, the side edge portion 37 of each of its two chain cloths implements a reflexed portion, and then combines the chain teeth on the reflexed portion, and then combines an concealed zipper slider between the two chain teeth. However, the lower blade 5 of the zipper slider is on the inner surface of the two chains, and the tab attaching portion 7 passes through the middle of the two chains to protrude from the front of the two chains, and then a tab 3 is combined on the tab attaching portion 7. Therefore, when the user pulls the tab 3, the lower blade 5 located on the inner side of the two chain cloths may still be caught in the inner fabric of the clothes, causing the zipper slider to jam.

SUMMARY OF THE INVENTION

The present invention has been accomplished under the circumstances in view. It is the main object of the present invention to provide an anti-pinch zipper which has the chain cloths and the zipper sliders so designed that the chain cloths can cover the bottom surface of the zipper slider to prevent the zipper slider from being caught in the clothing, and which allows the zipper to be implemented as a closed-end zipper, a single open end zipper, or a double open end zipper.

To achieve the above object, the anti-pinch zipper of the present invention comprises two zipper tapes and a zipper slider. The inner side of the chain cloth of each zipper tape is folded back to the front to form a chain belt portion and a sliding space. The rows of teeth are located on the respective chain belt portions. The zipper slider has a top plate. A connecting device and a pull tab are installed outside the top plate. The inner surface of the top plate is provided with a structure to guide the two rows of teeth to be interlocked with each other. In this way, the rows of teeth and chain belt portions are passed through the zipper slider, so that the top plate and the pull tab of the zipper slider are located on the front of the zipper, and the two chain cloths cover the back of the zipper slider, thereby forming a structure without any part of the zipper slider present on the back of the zipper. Since the zipper slider has no structure or parts protruding from the back of the chain cloths, when the anti-pinch zipper is applied to the clothing, it can prevent the zipper slider from being caught in the clothing when it moves.

DETAILED DESCRIPTION OF THE PREFERRED EMBODIMENTS

Figure 1:
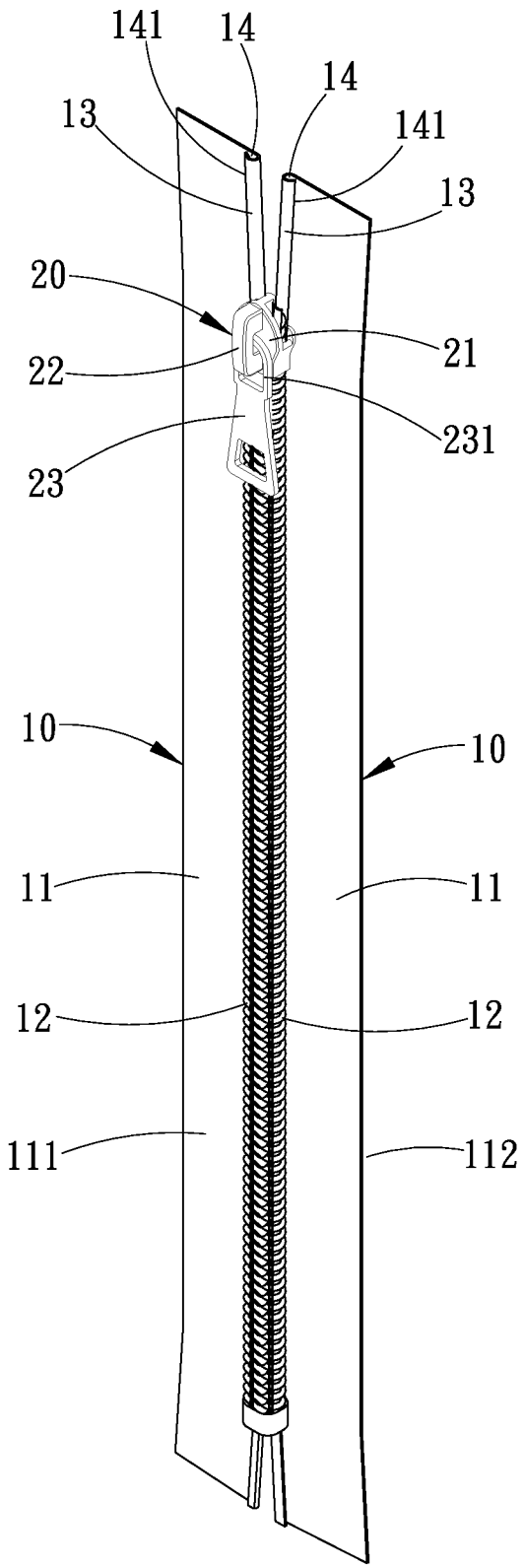
FIG. 1 is an elevational schematic diagram of the combined state of the anti-pinch zipper according to the preferred embodiment of the present invention.
Figure 2:
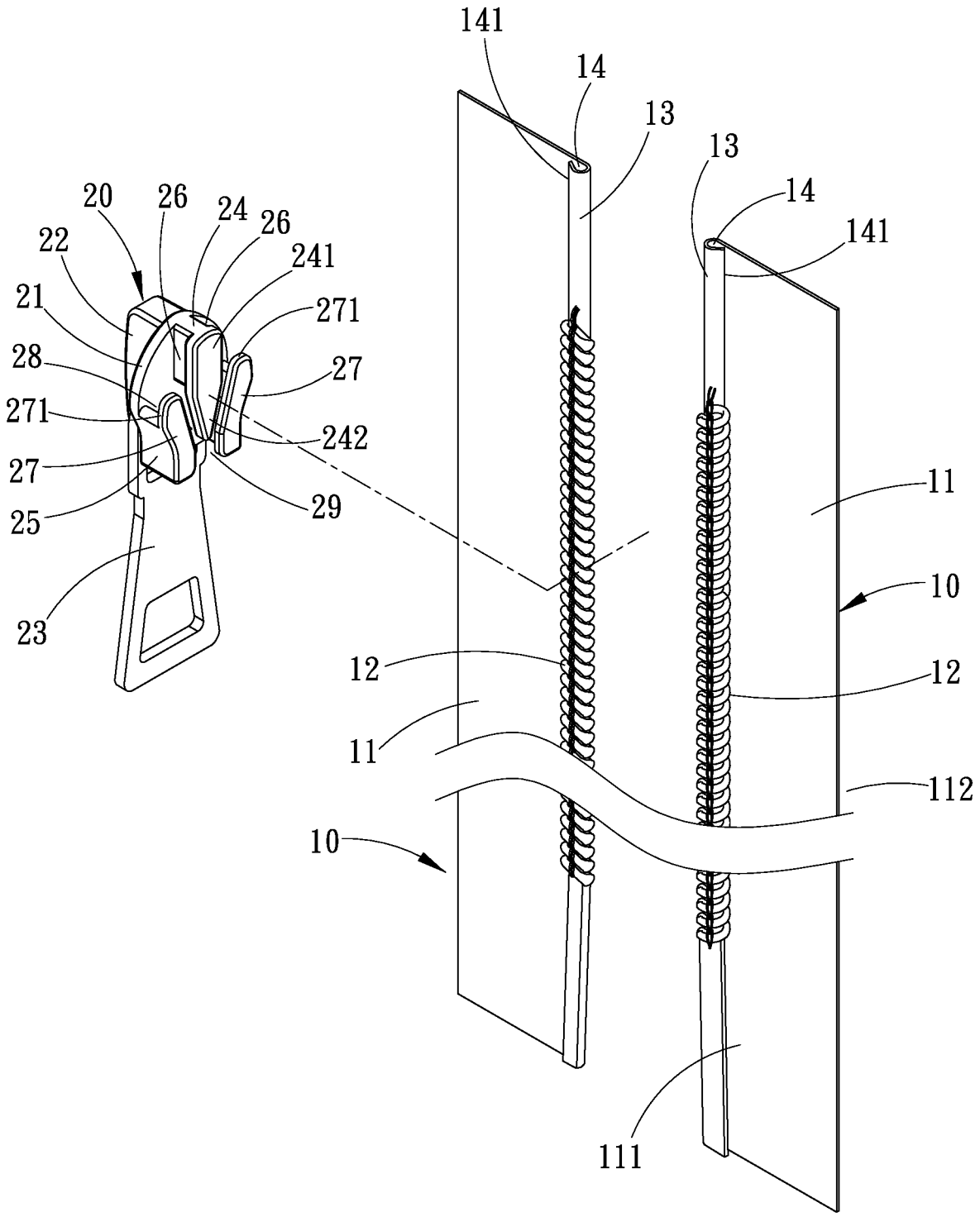
FIG. 2 is an elevational schematic view of the separated state of the anti-pinch zipper according to the preferred embodiment of the present invention.
Figure 3:
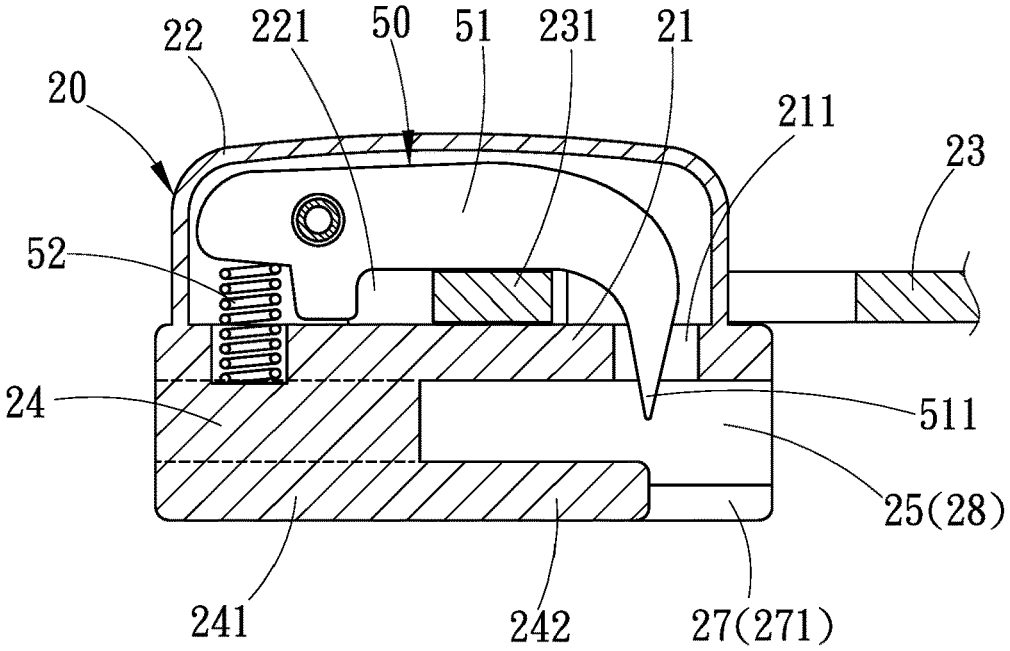
FIG. 3 is a schematic cross-sectional view of the anti-pinch zipper according to the preferred embodiment of the present invention.

As illustrated in FIGS. 1-3, an anti-pinch zipper of the present invention according to a preferred embodiment comprises two zipper tapes 10 and a zipper slider 20.

Figure 5:
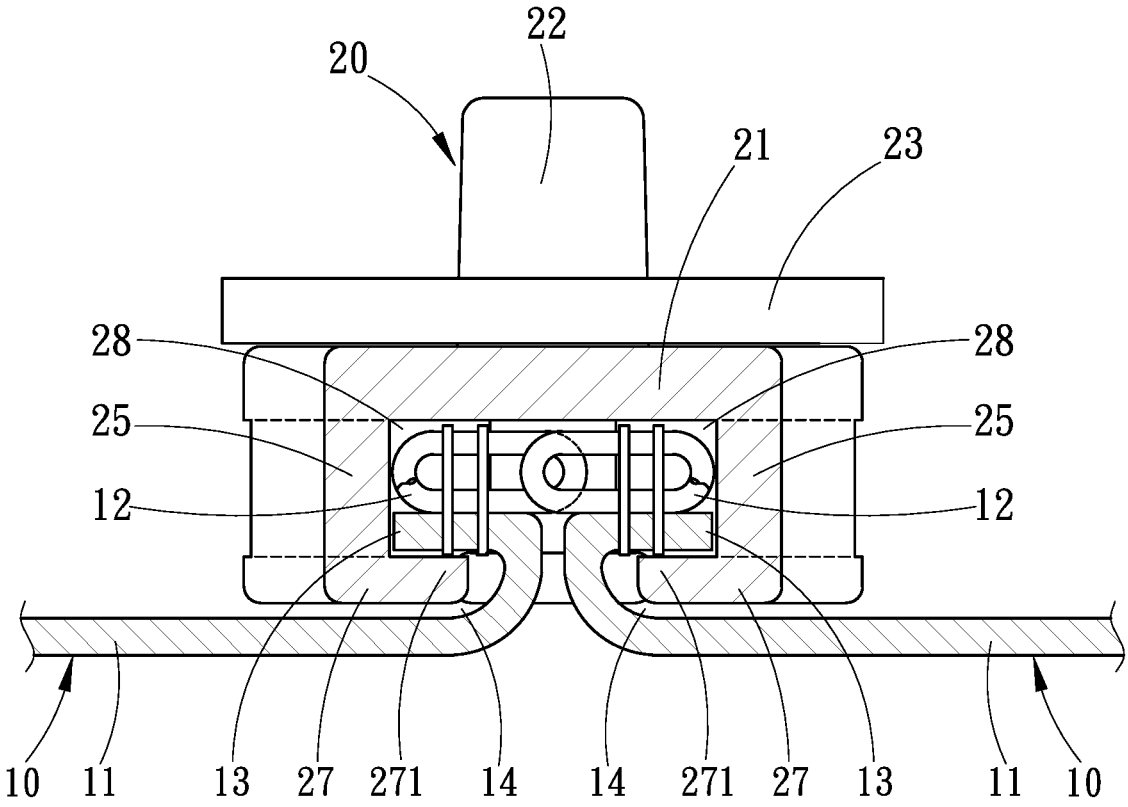
FIG. 5 is a schematic diagram of the I-I cross-section of the zipper slider of the present invention combined with the two chain cloths.
Figure 9:
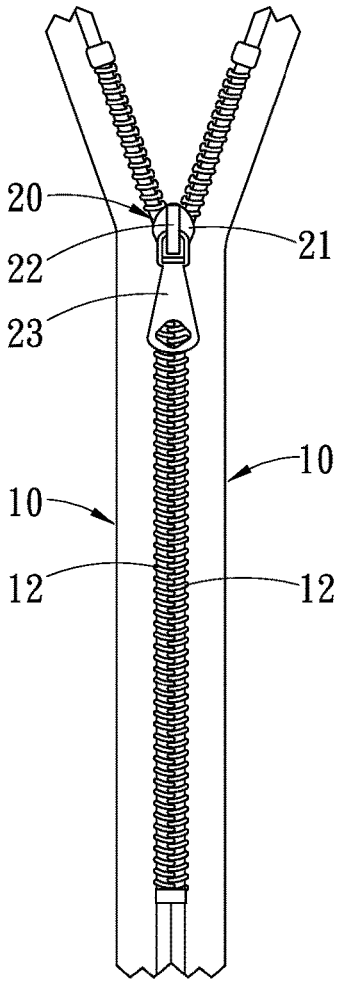
FIG. 9 is a schematic diagram of an implementation of the anti-pinch zipper of the present invention as a one-way closed-end zipper with one zipper slider.
Figure 10:
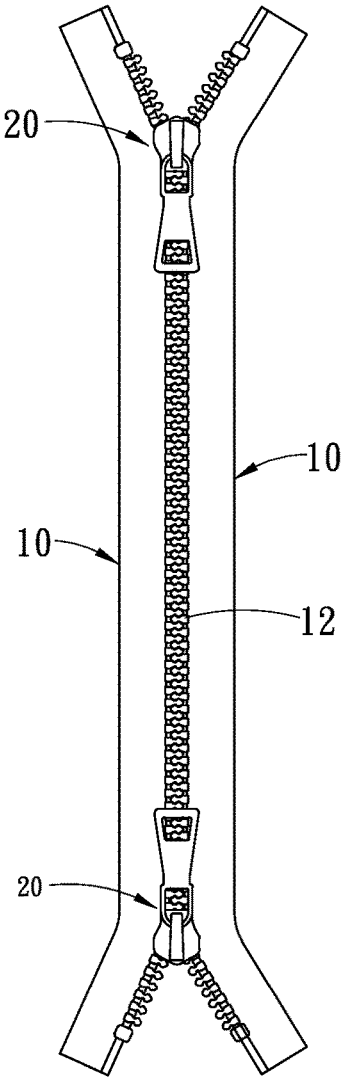
FIG. 10 is a schematic diagram of an implementation of the anti-pinch zipper of the present invention as an X-shaped two-way closed-end zipper with two zipper sliders.
Figure 12:
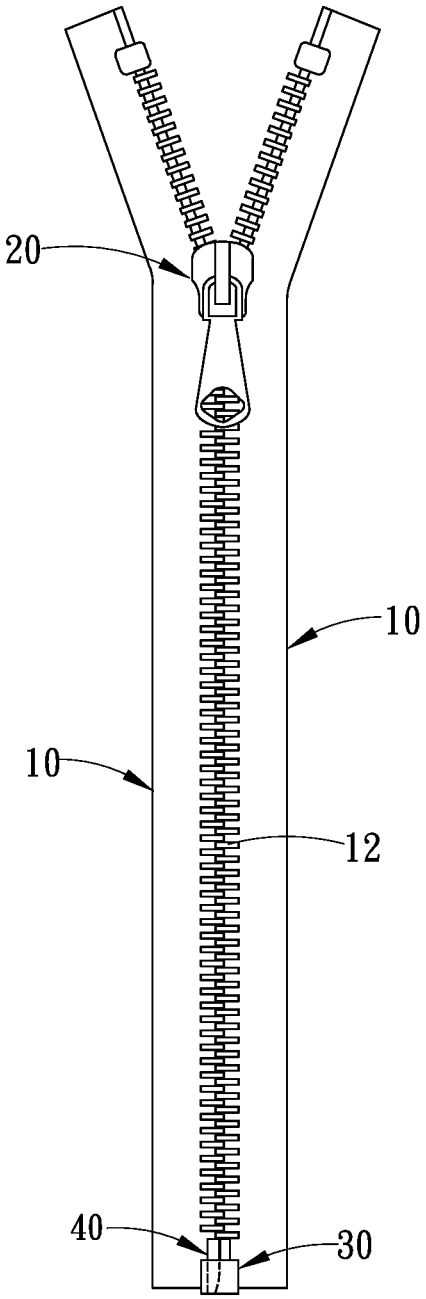
FIG. 12 is a schematic diagram of an implementation of the anti-pinch zipper of the present invention as a single open end zipper with one zipper slider.

As shown in FIGS. 1, 2 and 5, the two zipper tapes 10 each have a chain cloth 11 and a row of teeth 12. The inner side edge of the chain cloth 11 is folded back to the front 111 of the chain cloth 11 to form a chain belt portion 13. A sliding space 14 is formed between the chain belt portion 13 and the chain cloth 11. The opening 141 of the sliding space 14 faces the outer side of the chain cloth 11. The row of teeth 12 can be one of nylon row of teeth (as shown in FIG. 1 and FIG. 9), plastic steel row of teeth (as shown in FIG. 10) or metal row of teeth (as shown in FIG. 12). The row of teeth 12 is combined with the chain belt portion 13 on the front of the chain cloth 11, so that the row of teeth 12 is located on the front 111 of the chain cloth 11, and the back 112 of the chain cloth 11 covers the row of teeth 12 and the zipper slider 20.

Figure 4:
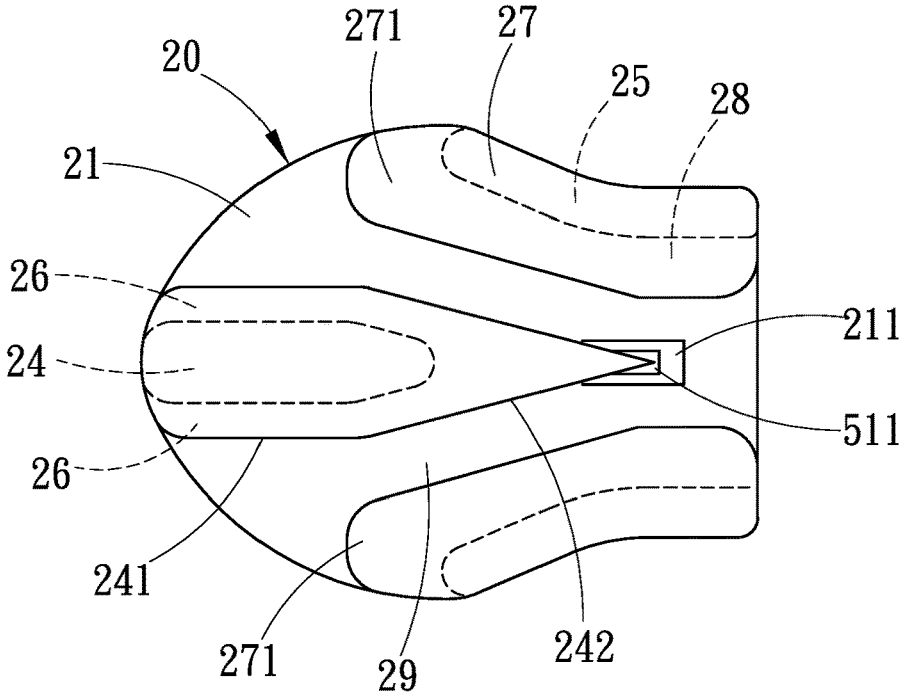
FIG. 4 is a schematic bottom view of the zipper slider of the anti-pinch zipper according to the preferred embodiment of the present invention.

As shown in FIGS. 2-4, the zipper slider 20 is used to slide between the two zipper tapes 10. The zipper slider 20 comprises a top plate 21, a connecting device 22, a pull tab 23, a base core 24 and two side plates 25. The top plate 21 is integrally formed or combined with the connecting device 22 on the outside, and the front end of the pull tab 23 is combined with the connecting device 22. The base core 24 is an integral block protruding from the center of the inner surface of the top plate 21. The end of the base core 24 is provided with a first guide plate 241. The width of the first guide plate 241 is greater than that of the rest of the base core 24. A first chain tooth sliding groove 26 is formed between the first guide plate 241 and the top plate 21 on two sides of the base core 24. The two side plates 25 are respectively connected vertically and integrally on both sides of the inner surface of the top plate 21, and the bottom ends of the two side plates 25 are respectively provided with a second guide plate 27. The inner edges of the two second guide plates 27 respectively have a convex plate 271 protruding toward the center, so that a second chain tooth sliding groove 28 is formed between the convex plates 271 of the two second guide plates 27 and the top plate 21, respectively. Moreover, the inner edge of the convex plates 271 of the second guide plates 27 and the two sides of the first guide plate 241 are spaced by a Y-shaped guide cloth seam 29.

Figure 6:
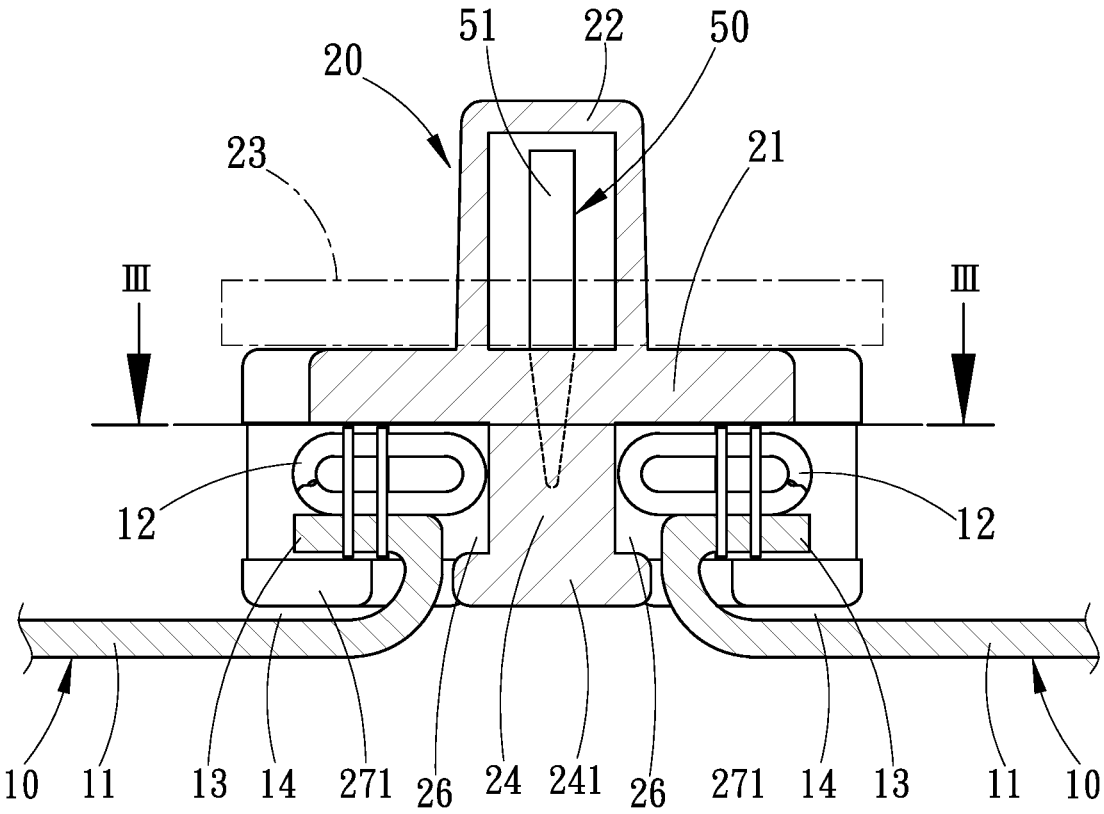
FIG. 6 is a schematic diagram of the II-II cross-section of the zipper slider of the present invention combined with the two chain cloths.
Figure 7:
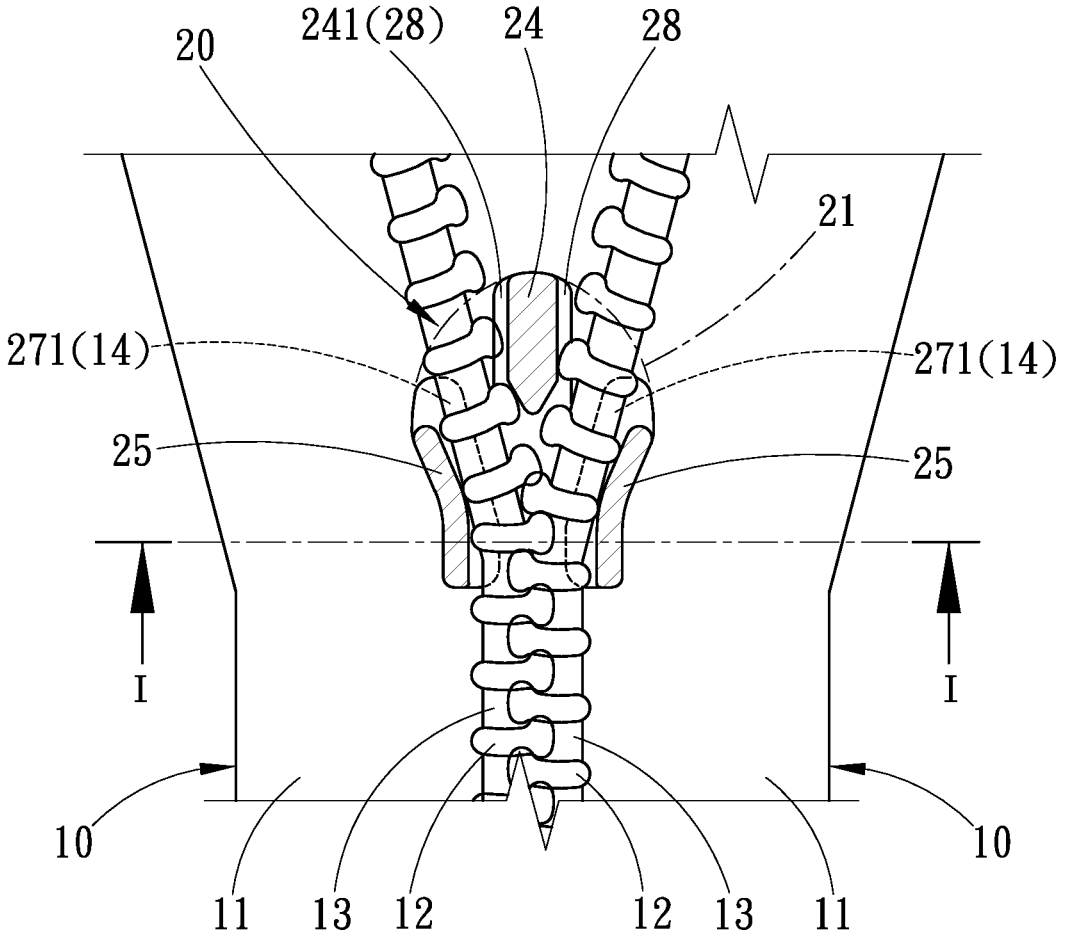
FIG. 7 is a schematic diagram of the III-III cross-section of the zipper slider of the present invention combined with the two chain cloths.
Figure 8:
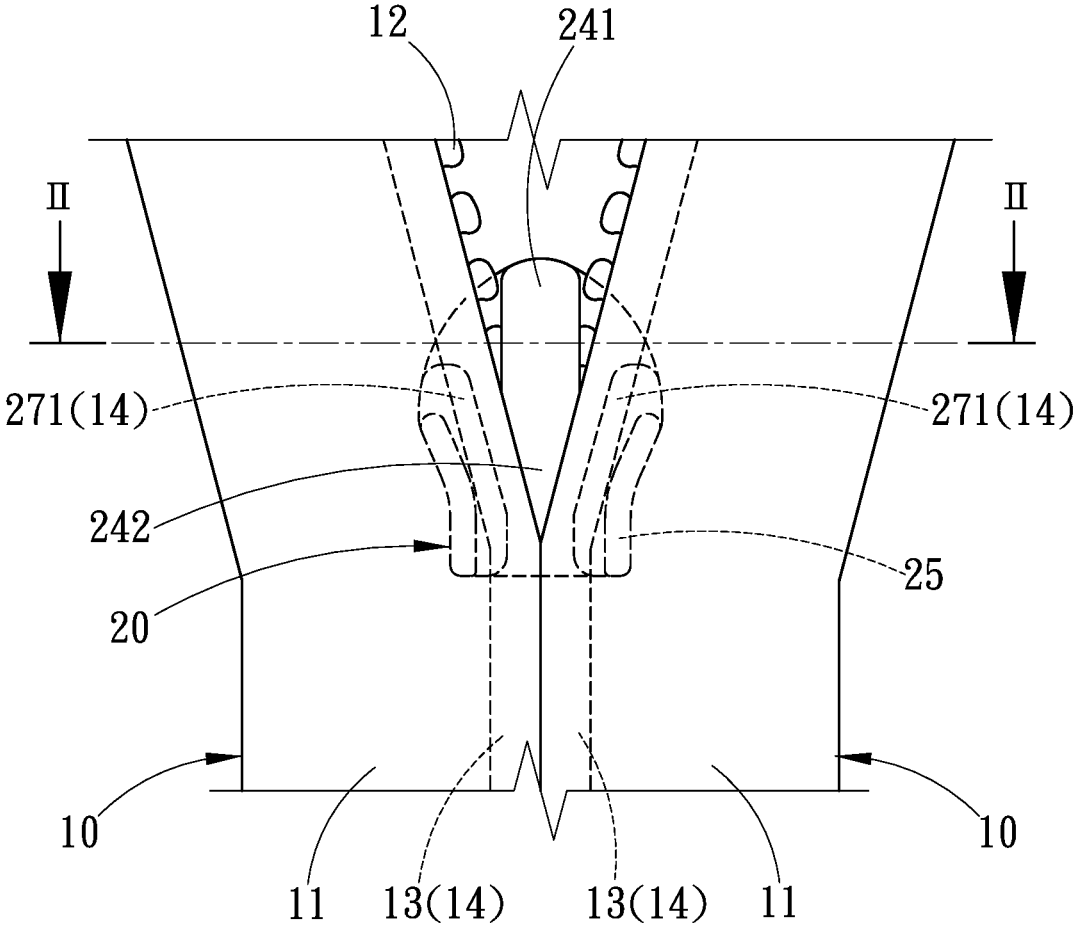
FIG. 8 is a schematic diagram of the back of the zipper slider of the present invention combined with the two chain cloths.

In this way, as shown in FIGS. 5-7, when the zipper slider 20 is combined between the two zipper tapes 10, the rows of teeth 12 and chain belt portions 13 of the two zipper tapes 10 pass through the first chain tooth sliding groove 26 and the second chain tooth sliding groove 28, and the two chain cloths 11 extend out of the bottom of the zipper slider 20 through the Y-shaped guide cloth seam 29, and expand to both sides of the zipper slider 20, so that the back of the two chain cloths 11 covers the zipper slider 20 (as shown in FIG. 8). Through the above combined structure, the top plate 21, the connecting device 22 and the pull tab 23 are formed at the front of the zipper, so that the top plate 21 leans against the rows of teeth 12 on the front of the zipper tapes 10, and no parts of the zipper slider 20 are present on the back of the two zipper tapes 10.

Referring to FIG. 6 and FIG. 8, when the zipper slider 20 moves, the first guide plate 241 is between the inner sides of the chain belt portions 13 of the two chain cloths 10, and the first guide plate 241 and the inner edge of the convex plate 271 guide the chain belt portions 13 through the Y-shaped guide cloth seam 29, so that the convex plate 271 of the second guide plate 27 slides in the sliding space 14 within the chain belt portions 13.

As shown in FIGS. 2, 4 and 8, the rear end of the above-mentioned first guide plate 241 forms a tapered portion 242 protruding from the rear end of the base core 24, and both sides of the tapered portion 242 are used for guiding against the inner side of the chain cloths 11.

As shown in FIG. 2 and FIG. 3, the connecting device 22 and the top plate 21 of the zipper slider 20 mentioned above can be implemented in a variety of functional structures. For example, the connecting device 22 can be integrally formed with the top plate 21, or the connecting device 22 can be assembled on the top plate 21, so that a perforation 221 is formed between the connecting device 22 and the top plate 21, and the front end of the pull tab 23 is implemented with a ring 231, so that the ring 231 passes through the perforation 221 and is sleeved on the connecting device 22 to pull the zipper slider 20.

Figure 19:
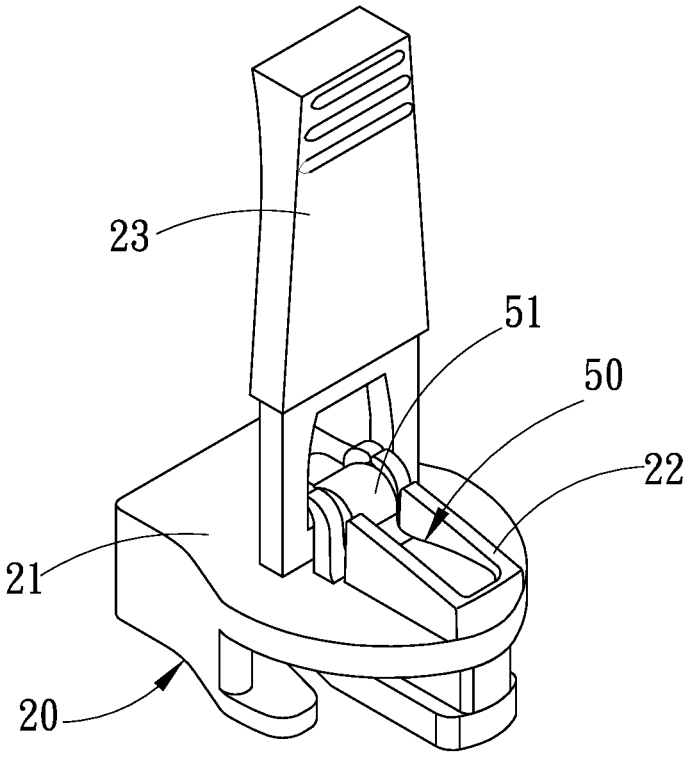
FIG. 19 is an elevational schematic diagram of the shrapnel-type locking device of the present invention.
Figure 20:
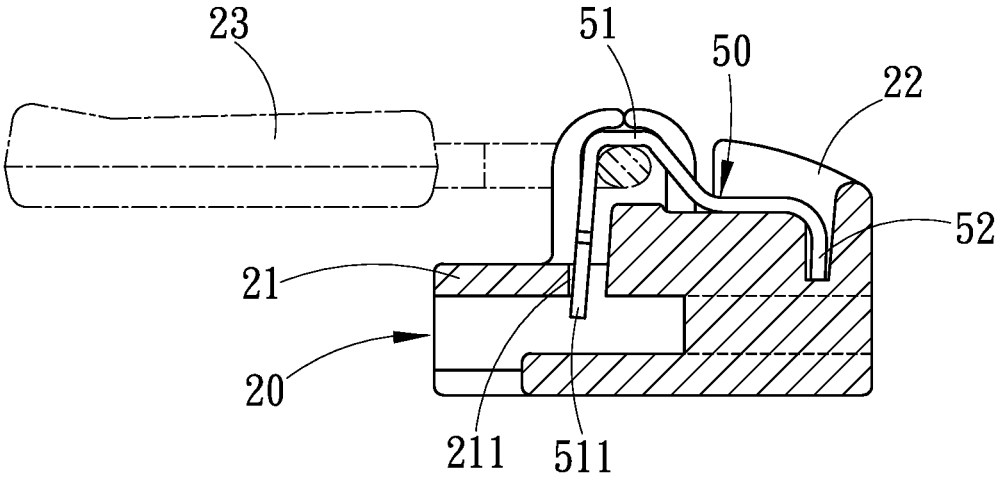
FIG. 20 is a schematic cross-sectional view of the shrapnel type locking device of the present invention.
Figure 21:
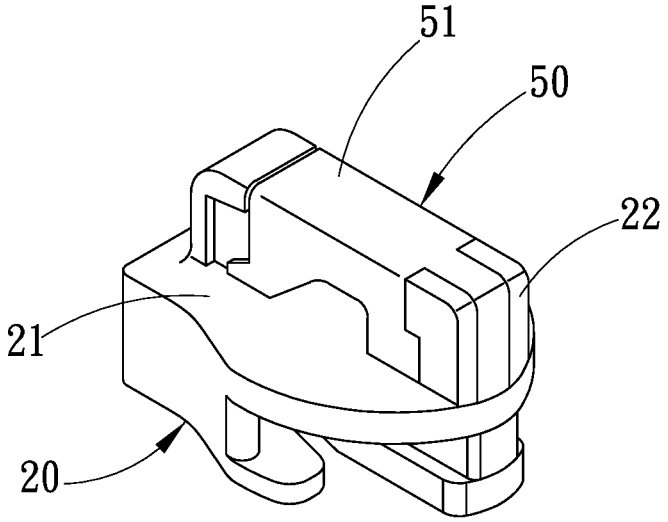
FIG. 21 an elevational schematic diagram of the European-style locking device of the present invention.
Figure 22:
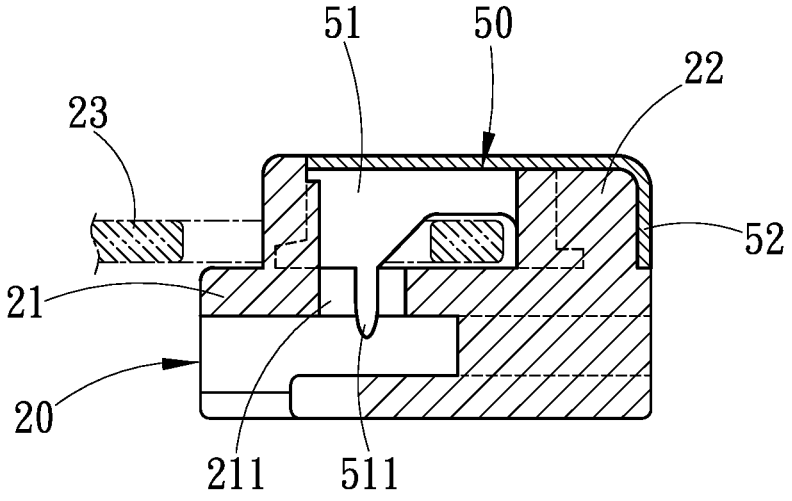
FIG. 22 is a schematic cross-sectional view of the European-style locking device of the present invention.

The above-mentioned connecting device 22 can also be implemented in other functional structures, for example, a locking device 50 can be implemented. The locking device 50 can be any structure that can be used to prevent the sliding of the zipper slider 20, such as a conventional automatic locking device (as shown in FIGS. 3-6), a spring-type locking device (as shown in FIGS. 19 and 20) or European locking device (as shown in FIGS. 21 and 22), etc. The locking device 50 is used to prevent the zipper slider 20 from sliding, and the zipper slider 20 can only be made to slide when the locking device 50 is pulled through the pull tab 23.

Referring to FIGS. 3-6 and 19-22 again, the above-mentioned various locking devices 50 are specifically provided with a movable stopper pin 51 on or within the connecting device 22. The shape of the stopper pin 51 is not limited. The front end of the stopper pin 51 is a hook-shaped tip 511. The back end of the stopper pin 51 is provided with an elastic structure 52. The elastic structure 52 can be a spring or a shrapnel formed by the back end of the stopper pin 51. The elastic structure 52 is used to push the stopper pin 51 so that the hook-shaped tip 511 at the front end of the stopper pin 51 passes through a through hole 211 of the top plate 21, and the hook-shaped tip 511 protrudes to the inner surface of the top plate 21 to be stuck on the interlocked rows of teeth 12 to prevent the zipper slider 20 from sliding down by itself. Only when the user pulls up the stopper pin 51 with the pull tab 23, can the hook-shaped tip 511 be separated from the interlocked rows of teeth 12, so that the zipper slider 20 can slide to open the zipper.

The anti-pinch zipper of the present invention uses the chain cloths 11 to cover the second guide plate 27 of the zipper slider 20, so that the zipper slider 20 does not have a structure that protrudes from the back of the chain cloths 11. When the anti-pinch zipper is applied to the garment, the zipper slider 20 is on the outside of the garment, and the back of the two zipper tapes 10 does not interact with any parts of the zipper slider 20, and so can prevent the zipper slider 20 from being caught in the inner fabric of the garment when it moves, thereby achieving the anti-pinch function.

Figure 11:
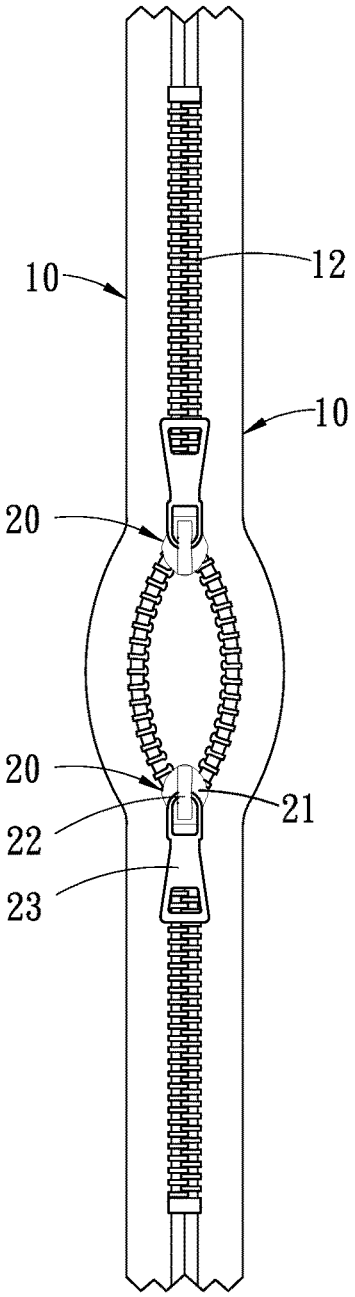
FIG. 11 is a schematic diagram of an implementation of the anti-pinch zipper of the present invention as an O-shaped two-way closed-end zipper with two zipper sliders.
Figure 13:
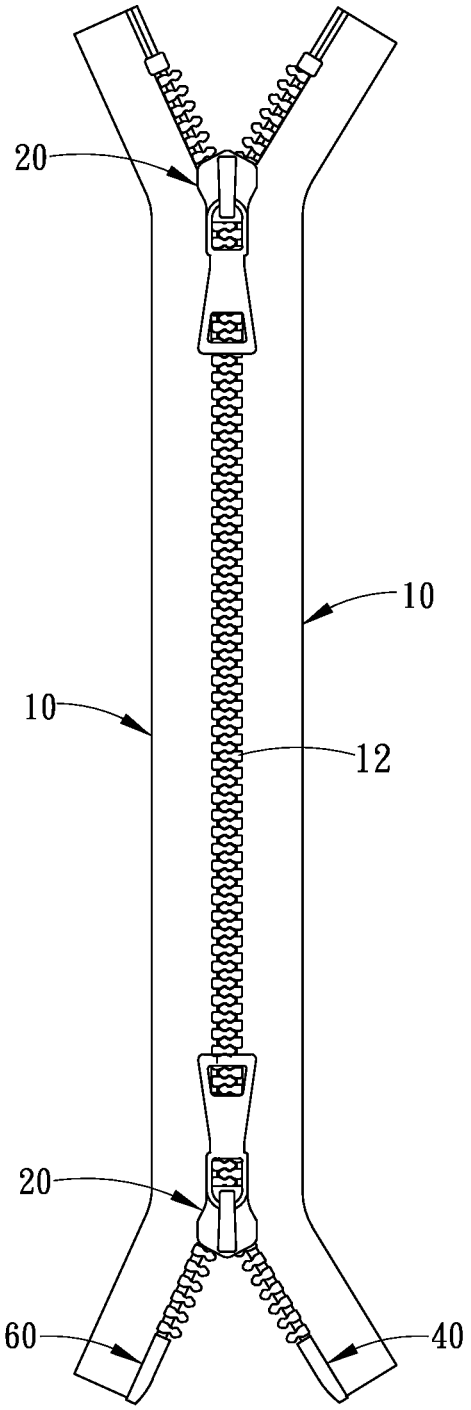
FIG. 13 is a schematic diagram of an implementation of the anti-pinch zipper of the present invention as a double open end zipper with two zipper sliders and two insert pins.
Figure 14:
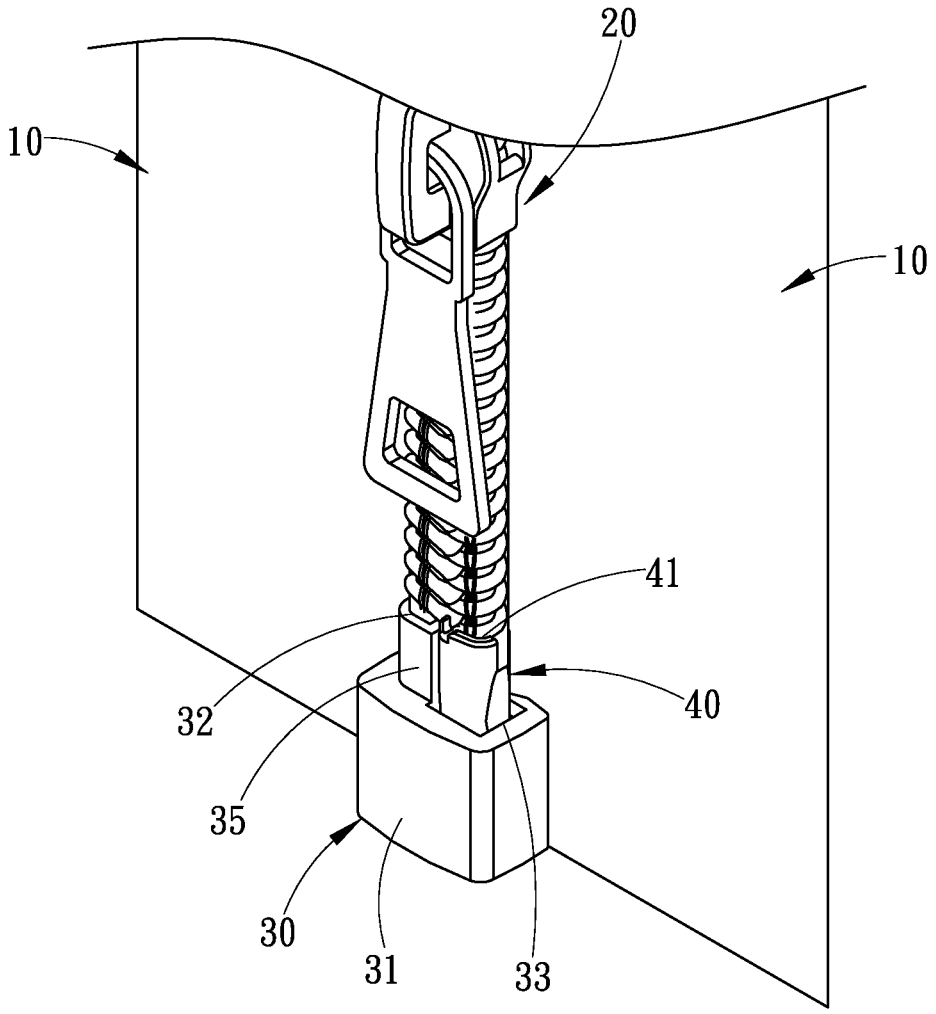
FIG. 14 is an elevational schematic diagram of the combined state of the lower stop block and the insert pin of the present invention.
Figure 15:
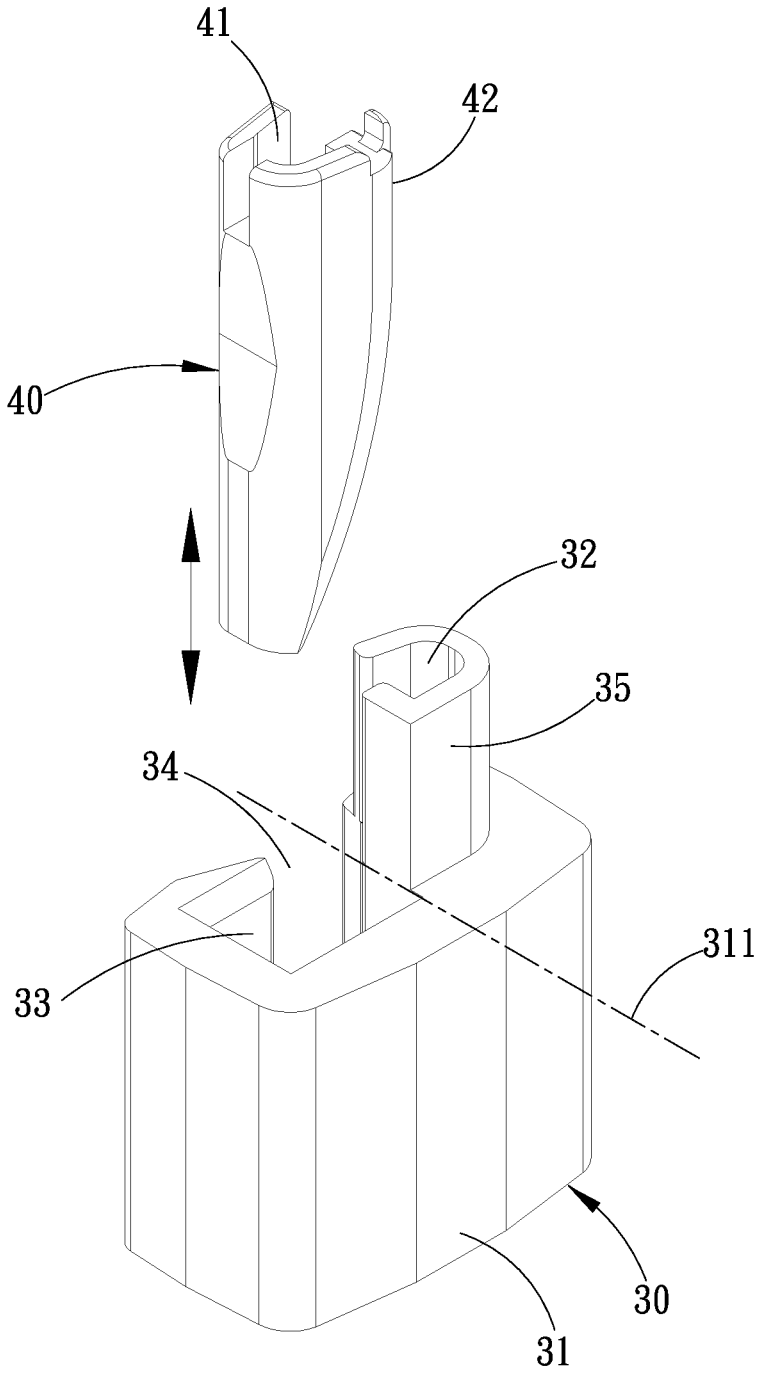
FIG. 15 is an elevational schematic diagram of the separated state of the lower stop block and the insert pin of the present invention.
Figure 16:
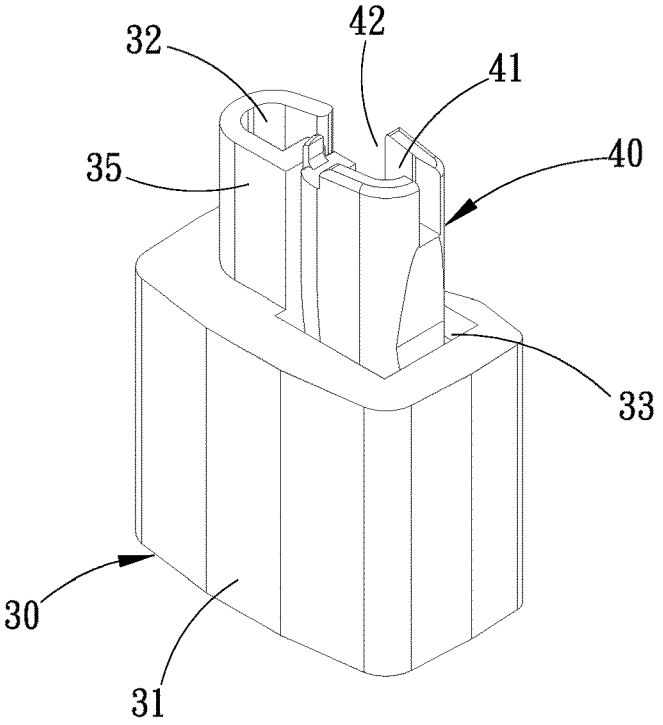
FIG. 16 is an elevational front view of the preferred embodiment of the lower stop block and insert pin of the present invention.
Figure 17:
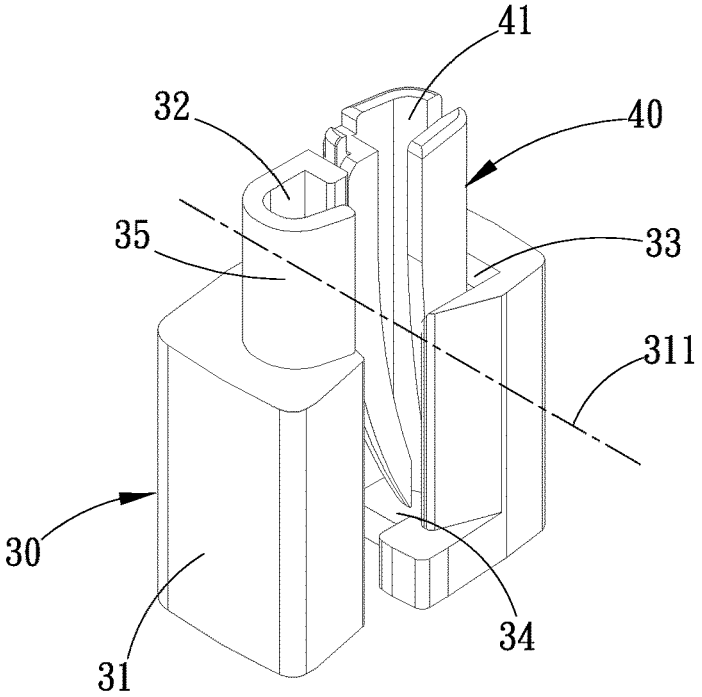
FIG. 17 is an elevational rear view of the preferred embodiment of the lower stop block and insert pin of the present invention.
Figure 18:
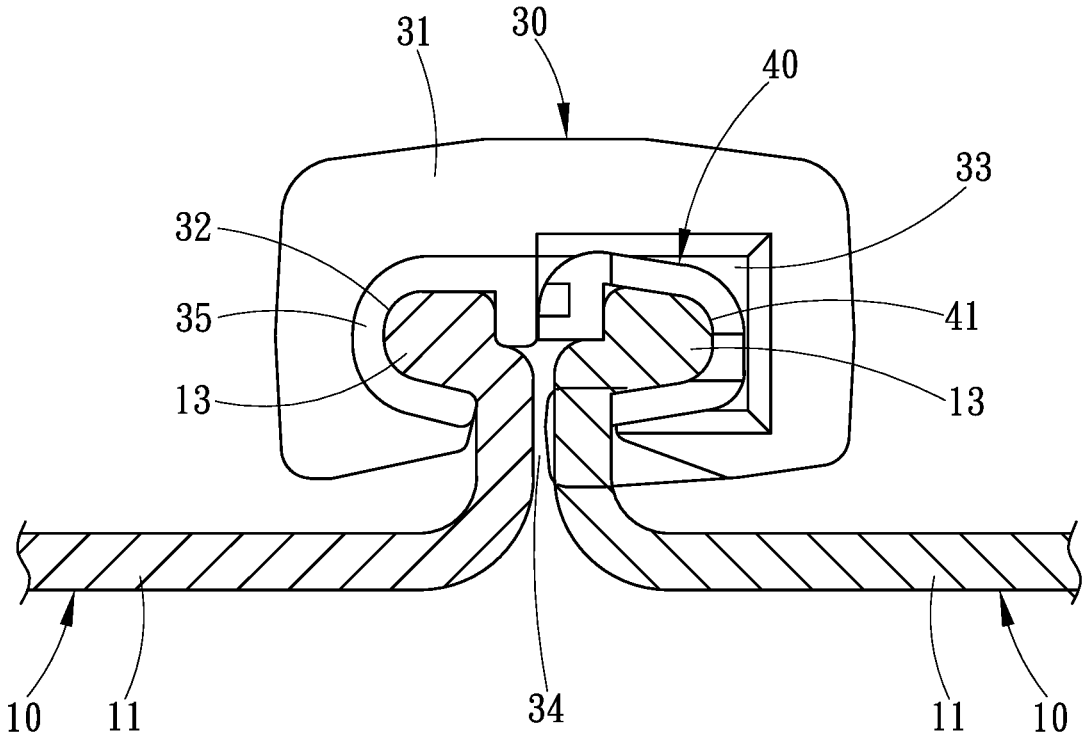
FIG. 18 is a schematic cross-sectional view of the combined state of the lower stop block and the insert pin of the present invention.

The invention can be implemented into various styles of zippers. As shown in FIG. 9, it can be implemented as a one-way closed-end zipper with a zipper slider 20; as shown in FIG. 10, it can also be implemented as an X-shaped two-way closed-end zipper with two zipper sliders 20; or as shown in FIG. 11, it can also be implemented as an O-shaped two-way closed-end zipper with two zipper sliders 20. The term "closed-end zipper" refers to a zipper whose ends of two zipper tapes 10 are never removed from the zipper slider 20. Or as shown in FIG. 12, the present invention can also be implemented as a single open end zipper, that is, the lower end of one of the two zipper tapes 10 can be pulled apart by the zipper slider 20, which is usually used for the two plackets of a jacket. Or as shown in FIG. 13, it can also be implemented as a double open end zipper, that is, a zipper in which the upper and lower ends of the two zipper tapes 10 can be separated.

Since the chain cloths 11 of the present invention are each implemented with a reverse-folded chain belt portion 13 and the row of teeth 12 is combined on the chain belt portion 13, when it is implemented as a single open end zipper or a double open end zipper, the required lower stop block and the insert pin must be improved together. For this, referring to FIGS. 12 and 14-18, in the present invention, a lower stop block 30 is provided at the proximal end of the chain belt portion 13 of one chain cloth 11, and an insert pin 40 is provided at the proximal end of the chain belt portion 13 of the other chain cloth 11. The lower stop block 30 and insert pin 40 can be alloy die-casting molding or plastic injection molding.

The lower stop block 30 has a rectangular block 31, the first side of the center line 311 of the rectangular block 31 is provided with a first fixing groove 32, and the second side of the center line 311 is provided with a slot 33. The first fixing groove 32 and the slot 33 are grooves recessed from the upper end to the lower end of the rectangular block 31, and the first fixing groove 32 is connected to the slot 33. An opening 34 is provided on the back of the rectangular block 31, and the opening 34 is connected to the first fixing groove 32 and the slot 33. In this way, the chain belt portion 13 of one chain cloth 11 is folded back and passed through the opening 34, and then fixed in the first fixing groove 32, so that the lower stop block 30 is fixed to the chain belt portion 13 of the chain cloth 11 near the end. A convex pin 35 protrudes from the upper end of the first side of the center line 311 of the rectangular block 31, and the first fixing groove 32 is recessed into the rectangular block 31 from the upper end of the convex pin 35 to the lower end.

The insert pin 40 is a bar corresponding to the slot 33. The insert pin 40 has a second fixing groove 41 recessed from its upper end to its lower end, and the second fixing groove 41 is connected to the inner side 42 of the insert pin 40.

In this way, the chain belt portion 13 of the other chain cloth 11 is folded back and fixed in the second fixing groove 41. In this way, the insert pin 40 can be inserted into the lower stop block 30 and can also be detached in the reverse direction, so that the anti-pinch zipper can be used as a single open end zipper or a double open end zipper.

Referring again to FIG. 13, when the present invention is applied to a double open end zipper, the chain belt portion 13 of one chain cloth 11 of the double open end zipper is provided with a fixing pin 60 at the proximal end, and the chain belt portion 13 of the other chain cloth 11 is provided with an insert pin 40 at the proximal end, thereby forming a double insert pin open end zipper. The insert pin 40 and the fixing pin 60 are fixed to the respective chain belt portions 13, as shown in FIG. 13 and the structure on the right side of FIG. 18.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An anti-pinch zipper, comprising two zipper tapes, and a zipper slider, wherein:

said two zipper tapes each comprise a chain cloth and a row of teeth, each said chain cloth having an inner side thereof turned toward a front thereof and turned back to an outer side to form a chain belt portion so that a sliding space is formed between said chain belt portion and the associated chain cloth, said sliding space having an open side thereof facing the outer side of the associated chain cloth, said row of teeth being combined with said chain belt portion of the associated chain cloth, so that said row of teeth is located at the front of the associated chain cloth;

said zipper slider comprises a top plate, a connecting device, a pull tab, a base core and two side plates; said connecting device being set outside said top plate, said pull tab having a front end thereof combined with said connecting device, the center of an inner surface of said top plate being convexly provided with said base core, said base core having a bottom end thereof provided with a first guide plate, the width of said first guide plate being greater than the width of said base core, a first chain tooth sliding groove between said first guide plate and said top plate being formed on two sides of said base core, said two side plates being vertically connected to two sides of the inner surface of said top plate, said two side plates each having a second guide plate at a bottom end thereof, an inner edge of each of said two second guide plates respectively having a convex plate protruding toward the center, a second chain tooth sliding groove being formed between said convex plates of said two second guide plates and said top plate, an inner edge of said convex plates of said second guide plates and two sides of said first guide plate being spaced to form a Y-shaped guide cloth seam;

said zipper slider is combined between said two zipper tapes, said rows of teeth and said chain belt portions pass through said first chain tooth sliding groove and said second chain tooth sliding groove, and said two chain cloths extend out of said zipper slider through said Y-shaped guide cloth seam and expand to both sides of said zipper slider, so that the back of said two zipper tapes covers said zipper slider;

said top plate, said connecting device and said pull tab are located at the front of the anti-pinch zipper, said top plate is leaning against said rows of teeth on the front of said chain cloths, and no parts of said zipper slider are present on the back of said two zipper tapes; and when said zipper slider moves, said first guide plate is between the inner sides of said chain belt portions of said two chain cloths, the inner edge of said convex plate guides said chain belt portions through said Y-shaped guide cloth seam, and said convex plate of each said second guide plate slides in said sliding space within said chain belt portions.

2. The anti-pinch zipper as claimed in claim 1, wherein said first guide plate has a rear end thereof forming a tapered portion protruding from the rear end of said base core, and both sides of said taped portion abut the inner sides of said chain cloths.

3. The anti-pinch zipper as claimed in claim 1, wherein a perforation is formed between said connecting device and said top plate; said pull tab has a ring located at the front end thereof, said ring passing through said perforation and set on said connecting device.

4. The anti-pinch zipper as claimed in claim 3, wherein said connecting device comprises a locking device for preventing said zipper slider from sliding; and said pull tab is disposed to unlock said locking device for allowing said zipper slider to slide.

5. The anti-pinch zipper as claimed in claim 4, wherein said locking device comprises a stopper pin, said stopper pin comprising a hook-shaped tip at a front end thereof and an elastic structure at a rear end thereof, said elastic structure pushing said stopper pin so that said hook-shaped tip penetrates a through hole of said top plate and protrudes to the inner surface of said top plate; and said pull tab ring is used to pull up said stopper pin.

6. The anti-pinch zipper as claimed in claim 1, wherein each said row of teeth is one of nylon row of teeth, plastic steel row of teeth or metal row of teeth.

7. The anti-pinch zipper as claimed in claim 1, wherein said two zipper tapes are implemented such that the anti-pinch zipper is a one-way or two-way closed end zipper, single open end zipper or double open end zipper.

8. The anti-pinch zipper as claimed in claim 1, wherein said two zipper tapes are implemented for a single open end zipper, the chain belt portion of one of the two chain cloths is provided with a lower stop block at a proximal end, and the chain belt portion of the other chain cloth is provided with an insert pin at a proximal end, wherein:

said lower stop block comprises a rectangular block, said rectangular block comprising a first fixing groove located on a first side of a center line thereof and a slot located on a second side of the center line; said first fixing groove and said slot are grooves recessed from an upper end to an opposing lower end of said rectangular block, and said first fixing groove is connected to said slot; said rectangular block has an opening on a back side thereof, said opening connecting said first fixing groove and said slot; the chain belt portion of the chain cloth corresponding to the lower stop block is folded back and passed through said opening and then fixed in said first fixing groove; and said insert pin is a bar corresponding to said slot, said insert pin having a second fixing groove recessed from an upper end thereof to an opposing lower end thereof, said second fixing groove being connected to an inner side of said insert pin; the chain belt portion of the chain cloth corresponding to the insert pin is folded back and fixed in said second fixing groove.

9. The anti-pinch zipper as claimed in claim 8, wherein the upper end of the first side of the center line of said rectangular block is a protruding convex pin, and said first fixing groove is recessed into said rectangular block from the upper end of said convex pin to the lower end.

10. The anti-pinch zipper as claimed in claim 1, wherein said two zipper tapes are implemented for a double open end zipper, a fixing pin is provided at a proximal end of the chain belt portion of one of the two chain cloths, and an insert pin is provided at a proximal end of the chain belt portion of the other chain cloth.

* * * * *